US009803644B2

(12) United States Patent
Bergamini et al.

(10) Patent No.: US 9,803,644 B2
(45) Date of Patent: Oct. 31, 2017

(54) BACK-TO-BACK CENTRIFUGAL PUMP

(71) Applicant: Nuovo Pignone Srl, Florence (IT)

(72) Inventors: Lorenzo Bergamini, Florence (IT); Donato Antonio Ripa, Florence (IT); Fabrizio Milone, Florence (IT)

(73) Assignee: Nuovo Pignone SRL, Florence (IT)

( * ) Notice: Subject to any disclaimer, the term of this patent is extended or adjusted under 35 U.S.C. 154(b) by 281 days.

(21) Appl. No.: 14/649,932

(22) PCT Filed: Dec. 2, 2013

(86) PCT No.: PCT/EP2013/075289
§ 371 (c)(1),
(2) Date: Jun. 5, 2015

(87) PCT Pub. No.: WO2014/086730
PCT Pub. Date: Jun. 12, 2014

(65) Prior Publication Data

US 2015/0330391 A1 Nov. 19, 2015

(30) Foreign Application Priority Data

Dec. 5, 2012 (IT) ..... FI2012A0272

(51) Int. Cl.
*F04D 1/06* (2006.01)
*F04D 1/10* (2006.01)
(Continued)

(52) U.S. Cl.
CPC ..... *F04D 1/066* (2013.01); *F04D 1/10* (2013.01); *F04D 29/426* (2013.01); *F04D 29/445* (2013.01); *F04D 29/628* (2013.01)

(58) Field of Classification Search
CPC ... F04D 1/02; F04D 1/06; F04D 1/063; F04D 1/066; F04D 1/10; F04D 29/426; F04D 29/445; F04D 29/628
(Continued)

(56) References Cited

U.S. PATENT DOCUMENTS 3,229,642 A * 1/1966 Lobanoff ..... F04D 1/063 415/100
3,232,235 A 2/1966 Pilarczyk
(Continued)

FOREIGN PATENT DOCUMENTS

CH 637185 A5 7/1983
CN 201627724 U 11/2010
(Continued)

OTHER PUBLICATIONS

International Search Report and Written Opinion issued in connection with corresponding application PCT/EP2013/075289 dated Jan. 22, 2014.
(Continued)

*Primary Examiner* — Ninh H Nguyen
*Assistant Examiner* — Brian P Wolcott
(74) *Attorney, Agent, or Firm* — GE Global Patent Operation

(57) ABSTRACT

A back-to-back centrifugal pump comprising a pump inlet, a pump outlet, a pump shaft, a set of first stages, and a set of second stages in a back-to-back arrangement. Between the two sets of stages an intermediate crossover module is arranged. The first and second sets of stages comprise respective first outer diaphragms and second outer diaphragms. The outer diaphragms and the intermediate crossover module are stacked together and form a pump casing. The intermediate crossover module forms at least one axial transfer channel between the two sets of stages, and a fluid
(Continued)

connection between the set of second stages and the pump outlet. The second diaphragms comprise each at least one peripherally arranged through aperture. The through apertures are aligned to form at least one passageway, which fluidly connects the axial transfer channel with a most upstream one of the impellers of the second set of stages.

20 Claims, 7 Drawing Sheets

(51) Int. Cl.
*F04D 29/42* (2006.01)
*F04D 29/44* (2006.01)
*F04D 29/62* (2006.01)

(58) Field of Classification Search
USPC ..... 415/100, 199.2
See application file for complete search history.

(56) References Cited

U.S. PATENT DOCUMENTS 3,788,764 A * 1/1974 Shuey ..... F04D 1/06 415/104
3,861,825 A 1/1975 Blom

FOREIGN PATENT DOCUMENTS

GB 549922 A * 12/1942 ..... F04D 1/066
GB 1381904 A 12/1942
GB 695434 A 8/1953
GB 549922 A 1/1975
GB 1381904 A * 1/1975 ..... F04D 17/125

OTHER PUBLICATIONS

Unofficial English translation of Chinese Office Action and Search Report issued in connection with corresponding CN Application No. 201380063693.2 on Aug. 19, 2016.

* cited by examiner

STATE OF THE ART

STATE OF THE ART

BACK-TO-BACK CENTRIFUGAL PUMP

FIELD OF THE INVENTION

The present disclosure concerns improvements in centrifugal pumps. More specifically, the disclosure relates to so called back-to-back centrifugal pumps.

DESCRIPTION OF THE RELATED ART

Centrifugal pumps are used in several industrial fields to boost the pressure of a liquid. Centrifugal pumps can include one or several stages. A multistage centrifugal pump comprises a plurality of stages arranged in series to sequentially increase the pressure of the fluid from a pump inlet to a pump outlet. The pump stages comprise an impeller mounted on a shaft and rotatingly housed in the pump casing. The liquid delivered by the impeller is collected in a diffuser arranged around the impeller and is returned through a return channel to the inlet of the next stage.

In some known embodiments the multistage centrifugal pump can include a back-to-back arrangement of the pump stages. The stages of a back-to-back pump are divided in two sets of stages. The impellers of a set of first stages are mounted on the shaft with the impeller inlets facing one end of the pump, while the impellers of a set of second stages are mounted with the impeller inlets facing the opposite end of the pump. The pump inlet is arranged at the first end of the pump and the pump outlet is arranged at the mid-span of the pump, between the set of first stages and the set of second stages.

The back-to-back arrangement of the stages allows the thrust on the shaft to be balanced without the need of a balance drum.

In other embodiments, the stages are arranged in an in-line configuration, wherein all the impellers are mounted with the impeller inlets facing the same pump end. The pump inlet and pump outlet, i.e. the suction manifold and the delivery manifold in this kind of pumps are arranged at the two opposite ends of the pump casing, all the impellers being arranged between the pump inlet and the pump outlet. The in-line configuration requires a balance drum mounted on the shaft, to balance the axial thrust generated by the working fluid on the impellers during pump operation.

FIG. 1A illustrates an in-line multistage centrifugal pump 1. The suction or inlet manifold of the in-line pump 1 is labeled 3. The outlet or delivery manifold 5 is arranged at the opposite side of the pump 1. A set of stages 7 is arranged between the inlet manifold 3 and the outlet manifold 5. The stages 7 comprise each a diaphragm 9 which houses a respective rotary impeller 9 mounted on a pump shaft 13. Stationary diffuser vanes and return vanes are arranged in each stage 7, as known to those skilled in the art. The diaphragms 9 are stacked together, along with a pump inlet section 15 and a pump outlet section 17, by means of tie bolts 19.

FIG. 1B illustrates a so-called back-to-back multistage centrifugal pump 21. The multistage pump 21 comprises a set of first stages 23A and a set of second stages 23B including respective diaphragms 25 and impellers 27, as well as stationary diffuser vanes and return vanes. The two sets of stages 23A and 23B are arranged in a back-to-back configuration, so that liquid entering an inlet manifold 29 arranged at one end of the pump will be processed through the set of first stages 23A, and diverted by an intermediate crossover module 31 towards the first most upstream stage of the sets of second stages 23B, which is arranged at the end of the pump opposite to the inlet manifold 29. From there the liquid is processed sequentially by the stages 23B and finally discharged through an outlet manifold (not shown in FIG. 1B) arranged in a central position, i.e. at the pump mid-span. The intermediate crossover module 31 is arranged between the set of first stages 23A and the set of second stages 23B. The intermediate crossover module 31 comprises fluid passages to transfer the partially pressurized fluid from the most downstream first stage 23A towards the set of second stages 23B. The intermediate crossover module 21 further comprises apertures for conveying the pressurized fluid from the most downstream second stage 23B towards the delivery or outlet manifold of the pump. The diaphragms 25 of the various stages 23A, 23B are stacked together with the intermediate crossover module 31 arranged there between. The stages 23A, 23B are arranged in a barrel 33 forming the outer part of the pump casing. The barrel 33 is closed at both ends of the pump to provide a liquid tight volume, wherein the stationary diaphragms 25 are arranged. Between the barrel 33 and the diaphragms 25 of the second stages 23B a fluid passageway 34 is formed, for transferring the liquid from the intermediate crossover module 31 to the inlet of the most upstream second stage 23B. Partially pressurized liquid flows through the intermediate crossover module 31 into the peripheral passageway 34 and is transferred from the pump mid-span to the left end (in the drawing), where the inlet of the most upstream second stage 23B is located. A further fluid passageway 36 is formed between the diaphragms 23A and the barrel 33. The second passageway 36 puts the outlet of the most downstream second stage 23B in fluid communication with the pump outlet through apertures provided in the intermediate crossover module 31.

The requirement for an external barrel 33 renders the pump structure rather complex. In an in-line multistage centrifugal pump according to FIG. 1A a simpler configuration of is readily available removing the outer casing, when the latter is not necessary thanks to lower operating temperature and pressure, or non-hazardous fluid. However, the in-line pump configuration has several disadvantages: a lower efficiency, because the balance drum produces higher volumetric losses than those of a back-to-back configuration; a less favorable rotordynamic stability; and a higher sensitivity of the residual axial thrust to the wear of the gaps.

A back-to-back multistage pump, vice-versa, cannot be designed without an external barrel, because of the complexity of the casing and the presence of cross-flow modules.

A need, therefore, exists for a more efficient and robust back-to-back, multistage centrifugal pump.

SUMMARY OF THE INVENTION

According to some embodiments, a centrifugal, multistage pump is provided, comprising a pump inlet, a pump outlet and a pump shaft extending across the pump. The pump further comprises a set of first stages, comprising respective first impellers, mounted on the pump shaft, and first outer diaphragms, and a set of second stages, comprising respective second impellers mounted on the pump shaft and second outer diaphragms. The outer diaphragms surround the impellers. Between the set of first stages and the set of second stages an intermediate crossover module is arranged. The stages are arranged in a back-to-back configuration. Thus, the first impellers of the first stages are arranged in a pressure-increasing sequence between the pump inlet and the intermediate crossover module, and the second impellers of the second stages are arranged in a pressure-increasing sequence between a pump end, opposite the pump inlet, and the intermediate crossover module. In some embodiments, the first outer diaphragms, the second outer diaphragms and the intermediate crossover module are stacked to form a pump casing. The intermediate crossover module forms at least one axial transfer channel between the first stages and the second stages, as well as a fluid connection between the second stages and the pump outlet.

In some embodiments the inlet of the axial transfer channel is in fluid communication with the outlet of the most downstream stage of the set of first pump stages, i.e. the stage at the highest pressure in this first set. In some embodiments, the outlet of the axial transfer channel is in fluid communication with a passageway leading to the inlet of the most upstream one of the pump stages of the second set, i.e. the stage at the lowest pressure. The passageway can be formed by the second diaphragms of the set of second stages. Each one of these second diaphragms can comprise each at least one through aperture. The through apertures of the various diaphragms are aligned to form the passageway, which fluidly connects the axial transfer channel of the intermediate crossover module with the most upstream one of said second impellers, i.e. the impeller adjacent the end of the pump opposite the pump inlet. In some embodiments, more than one axial transfer channel can be provided and, in an embodiment, a corresponding number of passageways are formed by corresponding through apertures in the second diaphragms. The through apertures are arranged in a peripheral position, i.e. radially outwardly with respect to the impellers of the pump stages, so that the passageway(s) formed by the through apertures do not interfere with the flow path along which the fluid processed by the pump flows.

A back-to-back arrangement is thus obtained, without the need for a barrel surrounding the diaphragms of the pump stages.

According to some embodiments, a centrifugal pump of the present disclosure comprises: a pump inlet; a pump outlet; a pump shaft; first stages, comprising first outer diaphragms and first impellers mounted for rotation on said pump shaft; second stages, comprising second outer diaphragms and second impellers mounted for rotation on the pump shaft; said first stages and said second stages being arranged back-to-back, the pump outlet being arranged between the first stages and the second stages; an intermediate crossover module positioned between the first stages and the second stages. The intermediate crossover module forms at least one axial transfer channel between the first stages and the second stages, and a fluid connection between the second stages and the pump outlet. The second diaphragms comprise through apertures forming at least one passageway, which fluidly connects said at least one axial transfer channel with an inlet of said second stages.

Features and embodiments are disclosed here below and are further set forth in the appended claims, which form an integral part of the present description. The above brief description sets forth features of the various embodiments of the present invention in order that the detailed description that follows may be better understood and in order that the present contributions to the art may be better appreciated. There are, of course, other features of the invention that will be described hereinafter and which will be set forth in the appended claims. In this respect, before explaining several embodiments of the invention in details, it is understood that the various embodiments of the invention are not limited in their application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which the disclosure is based, may readily be utilized as a basis for designing other structures, methods, and/or systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein.

DETAILED DESCRIPTION OF EMBODIMENTS OF THE INVENTION

The following detailed description of exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

Figure 1A:
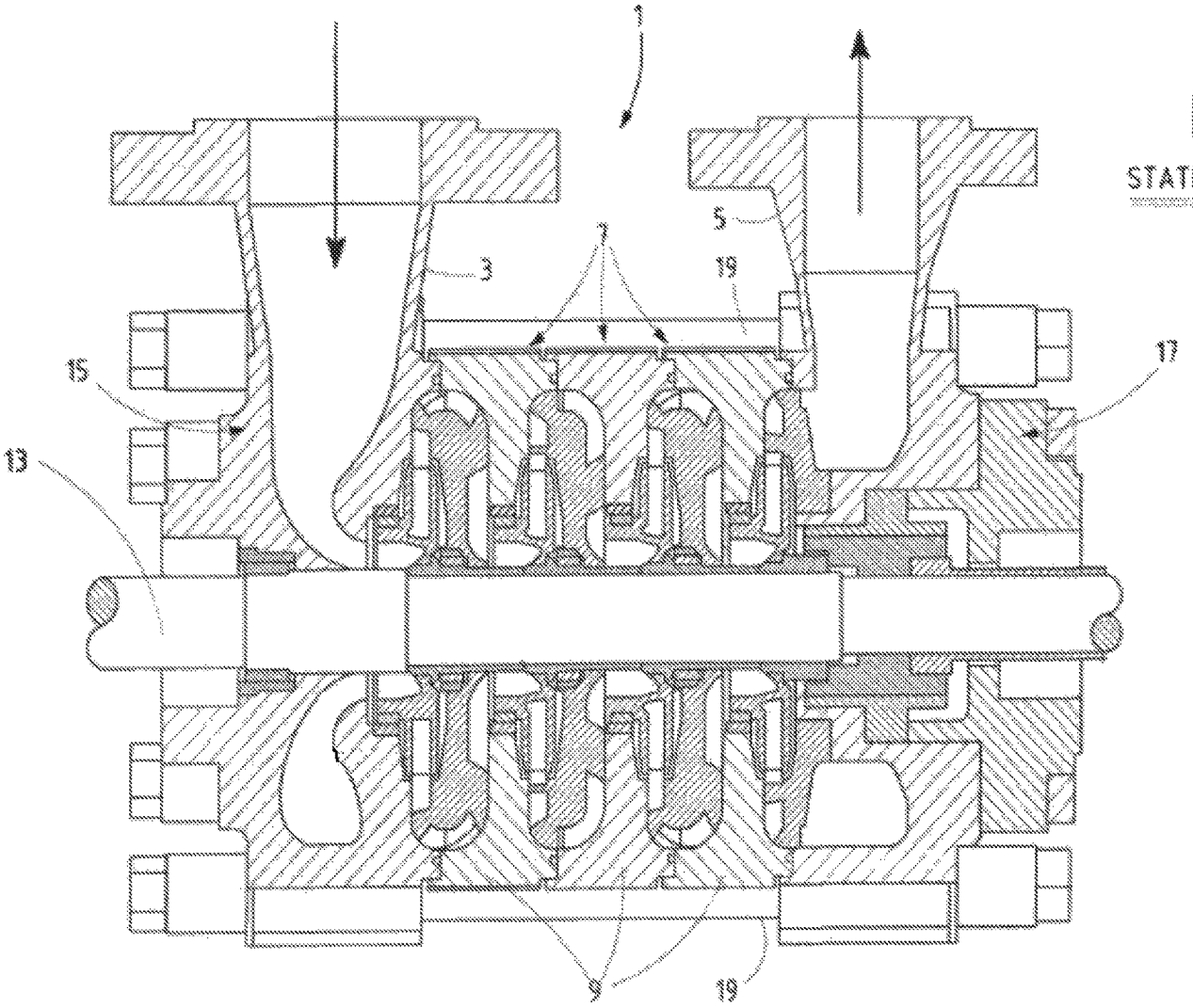
FIGS. 1A and 1B illustrate two multistage centrifugal pumps of the current art, in an inline and back-to-back arrangement, respectively.
Figure 1B:
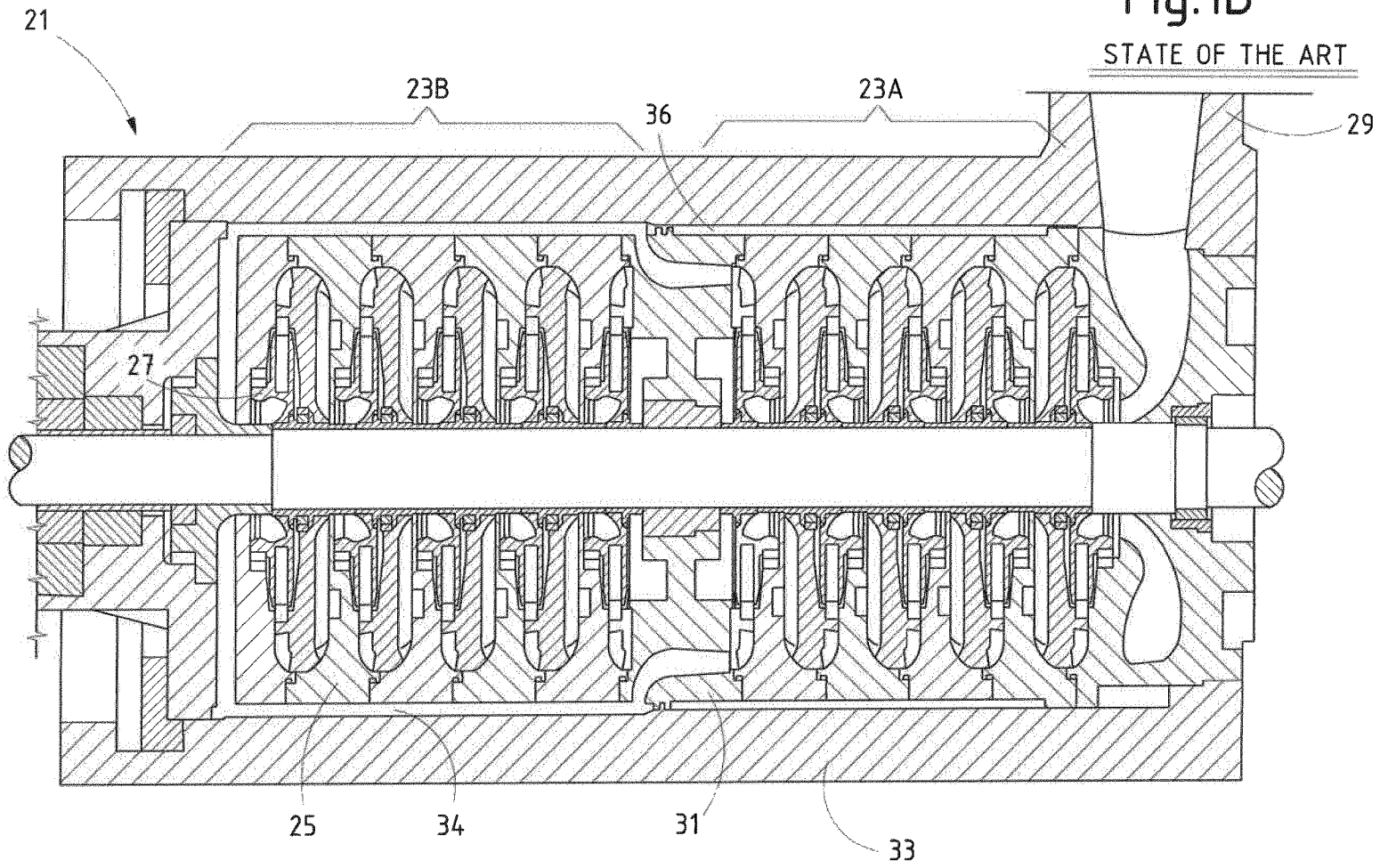
Figure 2:
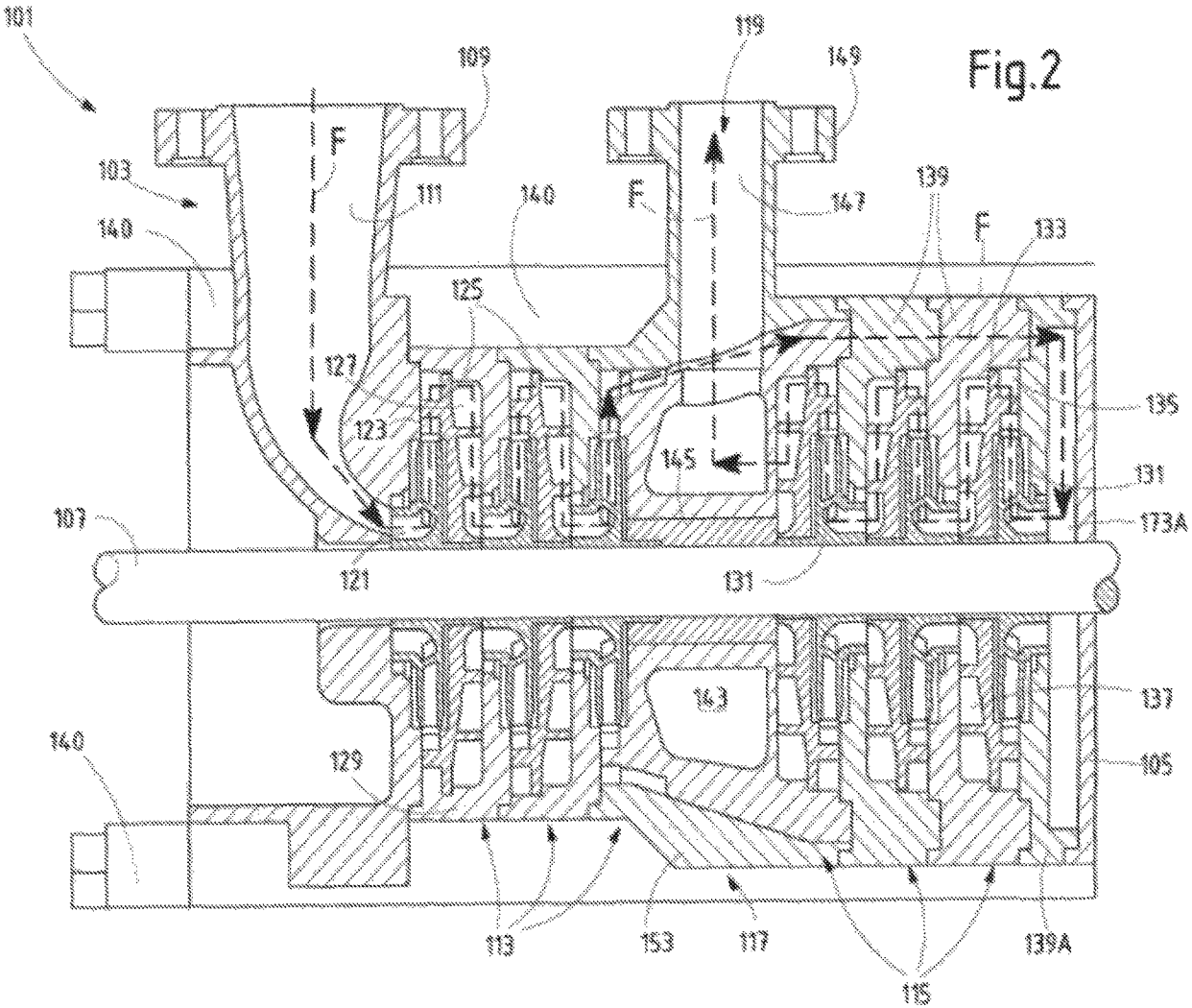
FIG. 2 illustrates a section along an axial plane of an embodiment of a multistage centrifugal pump in a back-to-back configuration according to the present disclosure.
Figure 3:
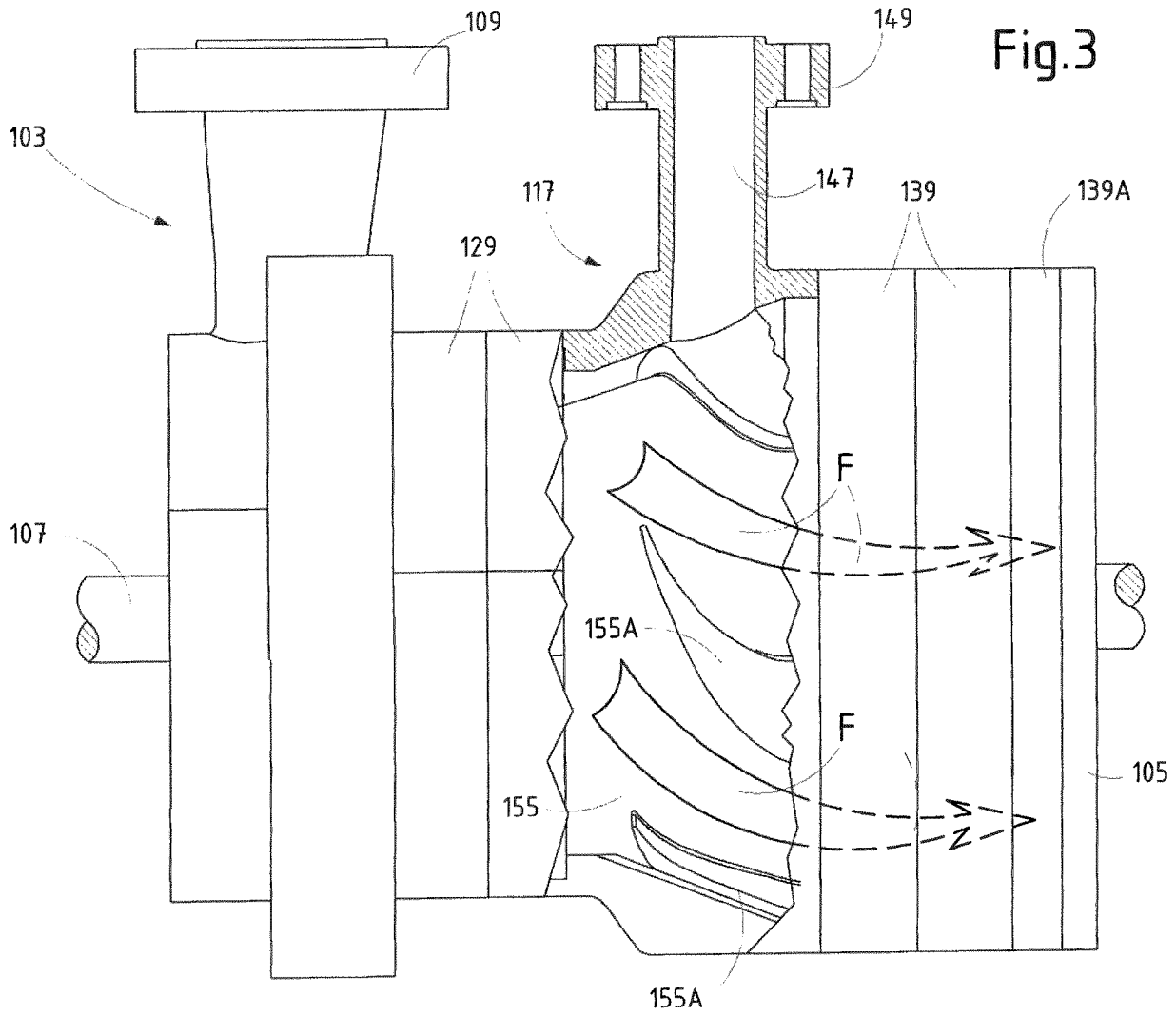
FIG. 3 illustrates a side view of the pump of FIG. 2 with partly broken away portions.

Referring now to FIGS. 2 and 3, a multistage centrifugal pump 101 according to the present disclosure comprises a suction module 103 arranged at one end of the pump 101. The opposite end of the pump is closed by a cover schematically shown at 105. A shaft 107 extends through the pump 101 and is supported at the opposite ends thereof by bearings, not shown. A plurality of impellers is mounted on the shaft 107 for integral rotation therewith, as will be disclosed in greater detail later on.

In some embodiments the suction module or inlet module 103 comprises an inlet flange 109 and forms a pump inlet 111 in fluid communication with the first one of a plurality of stages arranged between the suction module 103 and the opposite cover 105.

The pump further comprises a set of first stages 113 and a set of second stages 115. In the exemplary embodiment illustrated in the drawings, the pump comprises three first stages 113 and three second stages 115. A different number of stages can be provided. The two sets of stages can include the same number of stages or different numbers of stages. The stages 113 and 115 are arranged in a so called back-to-back configuration as will be described in greater detail here below.

Between the set of first stages 113 and the set of second stages 115 an intermediate crossover module 117 is arranged. The intermediate crossover module 117 has the task of transferring the partially pressurized fluid from the most downstream one of the first stages 113 towards the set of second stages 115, as well as to provide a fluid communication to a pump outlet 119, which is arranged at mid-span along the axial extension of the pump 101. The terms "upstream" and "downstream" as used herein in connection with the position of the pump stages are referred to the direction of the fluid flow in the pump. The most downstream stage of a stage set is therefore the last stage, through which the fluid flows. The most upstream stage of a stage set is conversely the first stage of the set, through which the fluid is processed. The fluid pressure increases when flowing from the most upstream to the most downstream stage of a set of stages.

According to some embodiments, each one of the first stages 113 comprises an impeller 121 mounted for rotation on the shaft 107. Each impeller 121 is provided with an arrangement 123 of stationary diffuser vanes. The diffuser vanes 123 are peripherally arranged around the radial outlet of the respective impeller 121. In some embodiments, some of the stages 113 comprise a respective disk 125 having two opposed faces or sides. The diffuser vanes 123 are arranged on a first side of the respective disk 125. Return vanes 127 are provided on the opposite face or opposite side of the disk 125. The disk 125 is provided with peripherally arranged apertures. The fluid delivered by the impeller is guided by the diffuser vanes towards the peripherally arranged through apertures provided in the disk 125, enters the return vanes 127 and is diverted thereby towards the inlet of the subsequent impeller of the next stage.

Some of the first stages 113 further comprise a respective outer or external diaphragm 129. In the exemplary embodiment of FIG. 2, the set of first stages 113 comprises three stages, each including a respective impeller 121. The first two stages 113 include a respective disk 125 as well as a respective outer diaphragm 129.

The most downstream one of the first impellers 113, i.e. the one which is arranged opposite the suction module 103 and adjacent the intermediate crossover module 117, comprises a set of diffuser vanes formed on, or supported by the intermediate crossover module 117 as will be described in more detail later on. The flow delivered by the most downstream impeller 121 enters a plurality of axial transfer channels formed in the intermediate crossover module 117, which are configured for transferring the partly pressurized fluid towards the inlet of the most upstream one of the second stages 115, i.e. the one arranged opposite the suction module 103 and adjacent the cover 105. The structure and function of the axial transfer channels will be described in more detail later on.

Similar to the first stages 113, each second stage 115 of the set of second stages 115 comprises an impeller 131, mounted for rotation on the shaft 107.

In some embodiments, each impeller 131 of the second stages 115 is combined with a disk 133 provided with a first side or face and a second side or face. A first side of each disk 133 supports or forms diffuser vanes 135. The opposite side of each disk 133 forms or supports return vanes 137.

Some of the second stages 115 further comprise a respective outer diaphragm 139 surrounding the respective impeller 131 and disk 133.

In the embodiment shown in the drawings the disk 125 and the outer diaphragm 129 of the set of first stages 113 are manufactured as separate components and assembled together. Similarly the disks 133 and the respective outer diaphragms 139 of the set of second stages 115 are manufactured as separate components and assembled together. In other embodiments, not shown, the disks and diaphragms of either the first stages 113 and/or of the second stages 115 can be manufactured as monolithic components.

The suction module 103, the cover 105, the intermediate crossover module 117 and the diaphragms 129, 139 are stacked and hold together by means of tie rods 140. A pump casing is thus formed, which has a substantially ring shaped structure, without any external monolithic barrel surrounding the diaphragms of the pump.

As shown in FIG. 2, the fluid flows in the pump through the pump inlet 111 provided in the suction module 103 and enters the most upstream one of the first stages 113. Arrow F schematically illustrates the path of the flow processed by the centrifugal pump 101. The fluid is partly pressurized in the most upstream one of the first stages 113, is radially discharged from the first impeller 121 and is collected by the diffuser vanes 123 and returned by the return vanes 127 towards the shaft 107 to enter the subsequent impeller 121 in the next stage and so on until the partly pressurized fluid exits radially from the most downstream impeller 121 of the first stages 113. The most downstream impeller 121 is the one arranged adjacent the intermediate crossover module 117.

Figure 5:
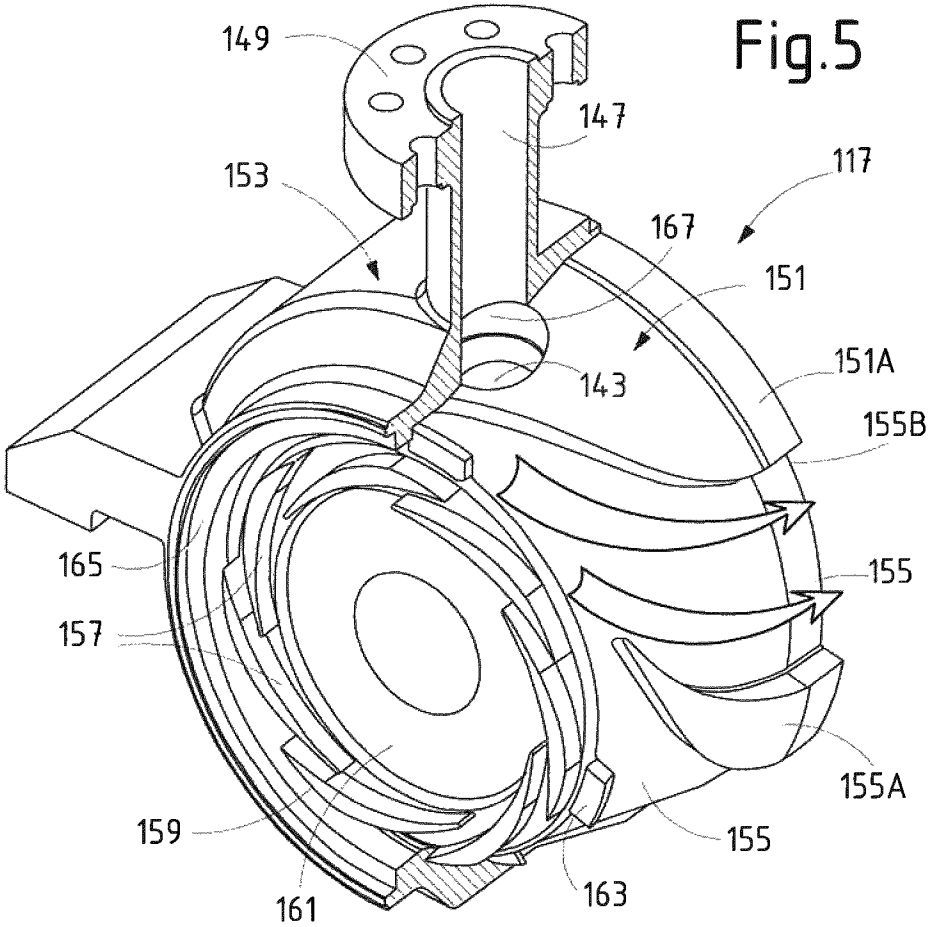
FIG. 5 illustrates a perspective view of the intermediate crossover module of the pump of FIGS. 2 to 4.

The fluid is then transferred across the intermediate crossover module 117 along axial transfer channels to be described later on with reference in particular to FIG. 5, and is then further transferred axially through passages or channels formed in the diaphragms 139 of the set of second stages 115. The last diaphragm, labeled 139A, of the set of second stages 115, i.e. the diaphragm arranged at the end of the pump opposite the suction module 103 and adjacent the cover 105, diverts the fluid towards the shaft 107 in the inlet of the most upstream stage 115. The most upstream stage 115 is the one arranged opposite the intermediate crossover module 117, i.e. the one nearest to the end of the pump 101 opposite the suction module 103.

The fluid is then sequentially pressurized flowing across the sequentially arranged second stages 115, until reaching the diffuser vanes 135 and the return vanes 137 of the most downstream stage 115, i.e. the stage 115 adjacent the intermediate crossover module 117.

The intermediate crossover module 117 comprises an inner chamber 143. In some embodiments the inner chamber 143 has a substantially annular shape surrounding an axial passage 145, through which the shaft 107 extends.

The inner chamber 143 is in fluid communication with an outlet or delivery manifold 147 ending with a delivery or discharge flange 149 and forming part of the pump outlet 119. The fluid therefore flows from the inner annular chamber 143 through the delivery manifold 147.

An embodiment of the intermediate crossover module 117 will be described in greater detail referring in particular to FIGS. 3 and 5.

The intermediate crossover module 117 can be comprised of an inner shell 151 and an outer shell 153. In FIG. 3 the outer shell 153 is sectioned along an axial plane, to show the inner shell 151 in a side view. FIG. 5 illustrates the intermediate crossover module 117 in a perspective view, with half of the outer shell 153 removed to better show the structure of the inner shell 151.

In this embodiment the two shells 151 and 153 are manufactured as separate components and subsequently assembled together. In other embodiments the inner shell 151 and the outer shell 153 can be monolithic, for example they can be die-cast as a single component.

The inner shell 151 has an outer surface 151A forming a plurality of axial transfer channels 155. In some embodiments four axial transfer channels 155 can be provided. The axial transfer channels can be uniformly distributed around the peripheral development of the inner shell 151. In some embodiments the radial dimension of the outer surface 151A of the inner shell 151 is increasing from the end facing the suction module 103 towards the end facing the opposite end of the pump 101.

In some embodiments each axial transfer channel 155 can have a substantially helical development. In some embodiments, each axial transfer channel 155 has a channel inlet 155A facing the set of first stages 113, and a channel outlet 155B facing the set of second stages 115. In some embodiments, the axial transfer channels 155 gradually diverge with respect to the shaft 107 from the channel inlet 155A towards the channel outlet 155B.

In some embodiments the channel inlet 155A of each axial transfer channel 155 is inclined with respect to the axial direction. The orientation of the channel inlet 155A of each axial transfer channel 155 is selected so as to facilitate the inflow of the partly pressurized fluid guided into the axial transfer channels 155 by stationary diffuser vanes 157 formed by stationary blades 159.

In some embodiments the stationary diffuser vanes 157 are formed on a side of a disk 161, which is mounted on the intermediate crossover module 117. In the embodiment illustrated in particular in FIG. 5, the disk 161 is formed as an integral part of the inner shell 151. In other words, the disk 161 and the inner shell 151 are e.g. die-cast as a monolithic component. In other embodiments, the disk 161 and the inner shell 151 can be manufactured as separate components and assembled together to form a unit.

In some embodiments the inner shell 151 comprises appendages 163 (see in particular FIG. 5), which engage with an annular projection 165 provided on the outer shell 153, for locking the inner shell 151 and outer shell 153 one with the other.

In some embodiments the channel outlet 155B of the axial transfer channels 155 is oriented substantially parallel to the axis of the shaft 107.

Each channel 150 can be closed at the radially outward side by the inner surface of the outer shell 153.

If the inner shell 151 and the outer shell 153 are manufactured as a monolithic component, the axial transfer channels 155 will be formed in the monolithic thickness of the intermediate crossover module 117 by die-casting.

In some embodiments, the inner shell 151 surrounds the inner annular cavity 141 of the intermediate crossover module 117 and comprises a discharge aperture 167, through which fluid communication can be established between the annular inner chamber 143 and the delivery manifold 147, through which the pressurized fluid is delivered.

The delivery manifold 147 can be manufactured monolithically with the outer shell 153. In other embodiments, the delivery manifold 147 can be attached to the outer shell 153.

Between the discharge aperture 167 and the delivery manifold 147 a sealing arrangement is provided according to an embodiment. The sealing arrangement prevents leakage of pressurized fluid between the inner surface of the outer shell 153 and the outer surface 151A of the inner shell 151 towards the axial transfer channels 155, due to the differential pressure between the fluid flowing through the discharge aperture 167 and the fluid flowing in the axial transfer channels 155.

A sealing arrangement around the discharged aperture 167 can comprise an O-ring or a gasket arranged between the inner surface of the outer shell 153 and outer surface of inner shell 151. In other embodiments a contact pressure between these two surfaces can provide sufficient sealing effect. Leakage is entirely avoided if the inner shell and the outer shell of the intermediate crossover module 117 are manufactured as a monolithic component, e.g. by die-casting.

The axial transfer channels 155 end in a radial position (see FIG. 4), which is aligned with corresponding through apertures or pockets 171 provided in the outer diaphragms 139 arranged between the cover 105 and the intermediate crossover module 117. The structure and position of the apertures 171 provided in the outer diaphragms 139 are shown in a perspective view in FIG. 6.

Figure 6:
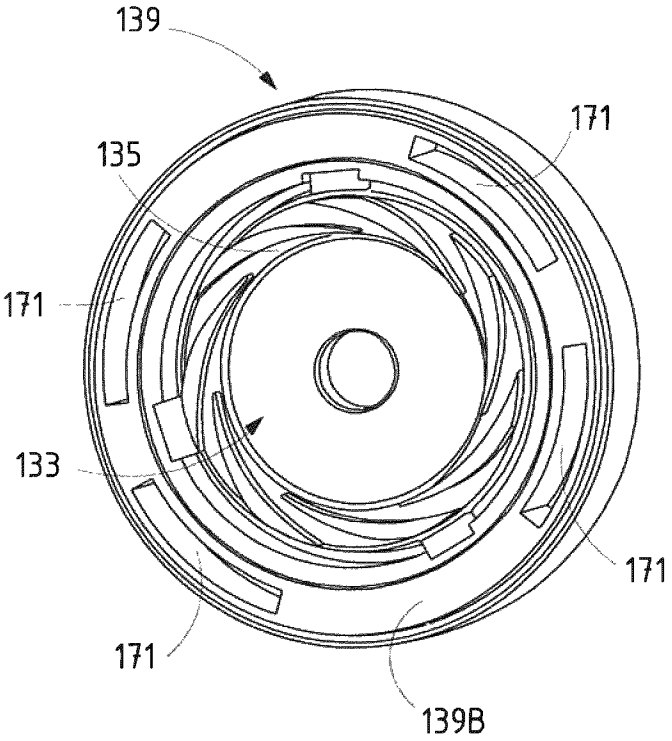
FIG. 6 illustrates a perspective view of one of the diaphragm of the set of second stages.

In the embodiment of FIG. 6, four through apertures or pockets 171 are provided along an annular solid portion 139B of the diaphragms 139.

In an embodiment, the cross section of the through apertures 171 matches the cross section of the outlet end 151B of the axial transfer channels 155, so that the partially pressurized fluid can smoothly flow from the axial transfer channels 155 into the through apertures 171.

Figure 8:
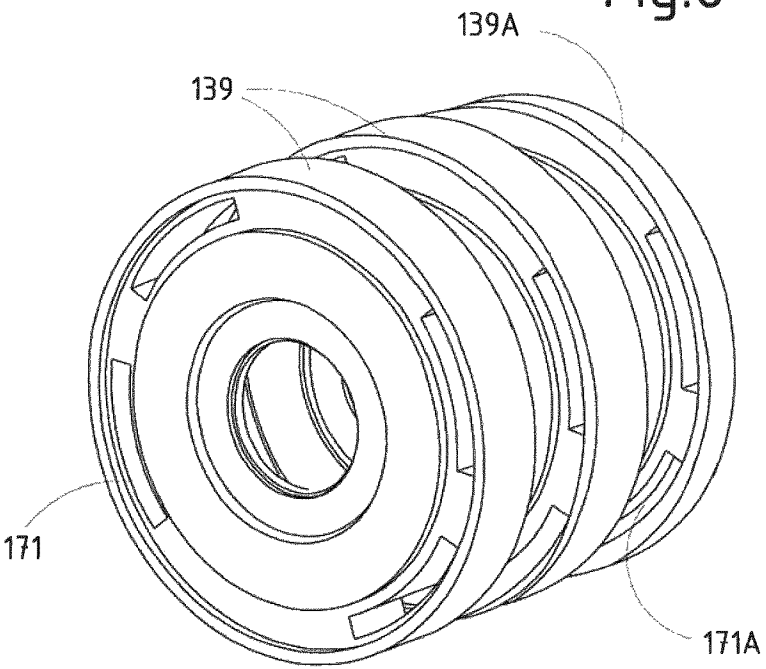
FIG. 8 illustrates a plurality of diaphragms of the set of second stages in a partially stacked arrangement.

As better shown in FIG. 8, the outer diaphragms 139 are stacked in a mutual angular position, such that the through apertures 171 of the outer diaphragms 139 are aligned one with the other forming a continuous passageway 173 extending from the respective axial transfer channel 155 to the end diaphragm 139A, i.e. the diaphragm arranged nearest to the closure cover 105.

Figure 4:
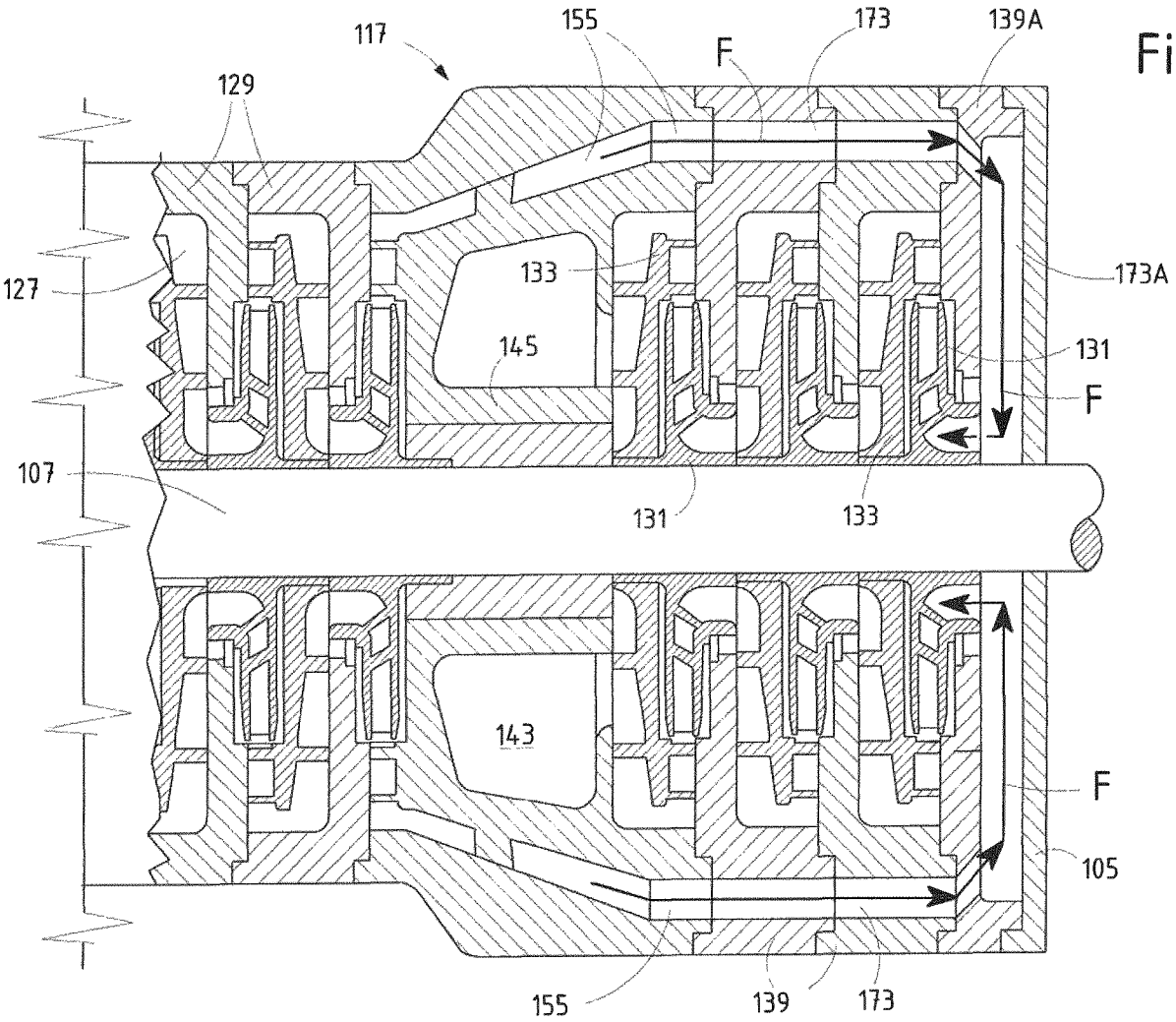
FIG. 4 illustrates an enlargement of the set of second stages of the pump of FIGS. 2 and 3.
Figure 7:
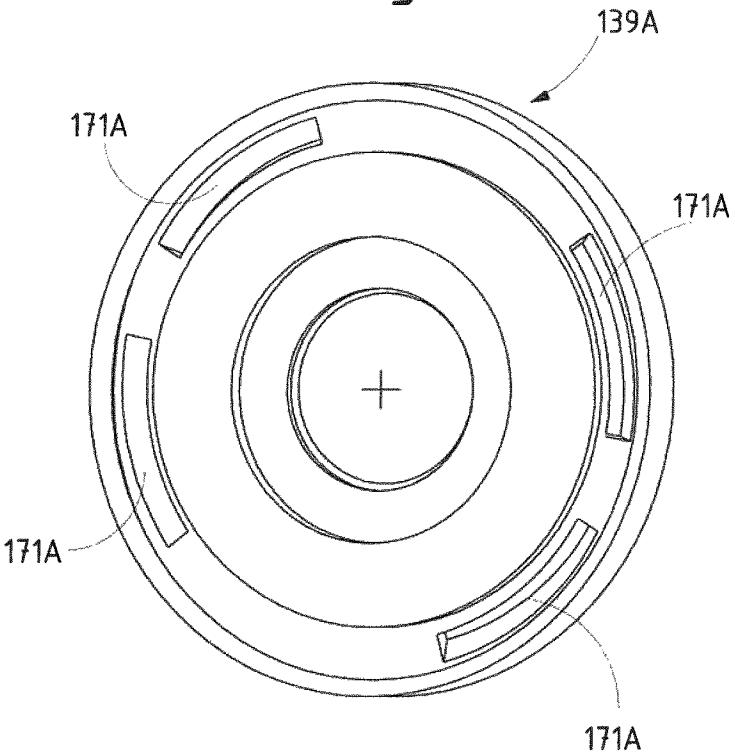
FIG. 7 illustrates the end diaphragm of the set of second stages.

As best shown in FIGS. 4 and 7, the last diaphragm 139A is also provided with through apertures 171A. In an embodiment, the inlets of apertures 171A are aligned with the through apertures 171 of the outer diaphragms 139, thus extending each passageway 173. In an embodiment, the cross section of the inlets of apertures 171A matches the cross section of through apertures 171.

The diaphragm 139A forms an end portion 173A of each passageway 173, leading to the inlet of the most upstream impeller 131 of the second stages 115.

An arrangement is thus provided, wherein the partly pressurized fluid exiting the most downstream one of the first stages 113 is transferred through the intermediate crossover module 117 and the passageways 173, 173A to the inlet of the most upstream stage 115, arranged at the end of the pump 101 opposite to the inlet end.

The above described arrangement allows therefore a back-to-back configuration of the two sets of stages 113, 115 with a ring type construction of the pump casing, i.e. a construction wherein the outer casing of the pump 101 is formed by the stack of diaphragms 129, 139, 139A and intermediate crossover module 117, without the need for an external barrel. The fluid path from the most downstream stage 113 to the most upstream stage 115 is formed partly inside the intermediate crossover module 117 and partly in the diaphragms 139, 139A.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. In addition, the order or sequence of any process or method steps may be varied or re-sequenced according to alternative embodiments.

What is claimed is:

1. A centrifugal pump, comprising:

a pump inlet;

a pump outlet;

a pump shaft;

a set of first stages, comprising first impellers, mounted on the pump shaft, and first outer diaphragms;

a set of second stages, comprising second impellers, mounted on the pump shaft, and second outer diaphragms; and an intermediate crossover module arranged between the set of first stages and the set of second stages, the first impellers being arranged in a pressure-increasing sequence between the pump inlet and the intermediate crossover module, and the second impellers being arranged in a pressure-increasing sequence between a pump end opposite said pump inlet and said intermediate crossover module, wherein:

said first outer diaphragms, said second outer diaphragms and said intermediate crossover module are stacked to form a pump casing, the intermediate crossover module forms at least one axial transfer channel between the set of first stages and the set of second stages, and a fluid connection between the set of second stages and the pump outlet, each one of said second outer diaphragms comprises at least one peripherally arranged through aperture, and said through apertures are aligned to form at least one passageway, which fluidly connects said at least one axial transfer channel with a most upstream one of said second impellers.

2. The centrifugal pump of claim 1, wherein:

each second outer diaphragm comprises a plurality of peripherally arranged through apertures, said intermediate crossover module comprises a plurality of axial transfer channels, and the through apertures of said second outer diaphragms form a plurality of passageways, which fluidly connect the axial transfer channels with the inlet of said most upstream second impeller.

3. The centrifugal pump of claim 1, wherein said intermediate crossover module comprises an annular inner chamber in fluid communication with said second stages and with said pump outlet.

4. The centrifugal pump of claim 1, wherein said intermediate crossover module comprises an inner shell and an outer shell, said inner shell and said outer shell being arranged one inside the other.

5. The centrifugal pump of claim 3, wherein the intermediate crossover module further comprises an inner shell and an outer shell, arranged one inside the other, and wherein the inner shell has a discharge aperture connecting the annular inner chamber to a radial discharge duct arranged in the outer shell, said radial discharge duct being in fluid communication with the pump outlet.

6. The centrifugal pump of claim 5, further comprising a sealing arrangement between the inner shell and the outer shell, around the discharge aperture.

7. The centrifugal pump of claim 4, wherein said inner shell has a substantially frustum-conical shape.

8. The centrifugal pump of claim 4, wherein said at least one axial transfer channel is arranged between the inner shell and the outer shell.

9. The centrifugal pump of claim 8, wherein said at least one axial transfer channel is formed between an outer surface of the inner shell and an inner surface of the outer shell.

10. The centrifugal pump of claim 4, wherein said outer shell forms a pump outlet flange.

11. The centrifugal pump of claim 1, further comprising a diffuser arranged between a most downstream one of said first stages and said intermediate crossover module.

12. The centrifugal pump of claim 11, wherein said diffuser is formed on said intermediate crossover module.

13. The centrifugal pump of claim 1, wherein a last one of said set of first stages comprises stationary diffuser vanes between the respective impeller and the intermediate crossover module and wherein said stationary diffuser vanes of said last one of said set of first stages are in fluid communication with said at least one axial transfer channel.

14. The centrifugal pump of claim 1, wherein said at least one axial transfer channel extends according to an substantially helical curve around the pump shaft.

15. The centrifugal pump according to claim 1, wherein said at least one axial transfer channel has an inlet end, which forms an angle with an axial direction, for receiving a fluid flow having a tangential speed component, and an outlet end oriented in a direction substantially parallel to the pump shaft.

16. The centrifugal pump of claim 2, wherein said intermediate crossover module comprises an annular inner chamber in fluid communication with said second stages and with said pump outlet.

17. The centrifugal pump of claim 16, wherein said intermediate crossover module comprises an inner shell and an outer shell, said inner shell and said outer shell being arranged one inside the other.

18. The centrifugal pump of claim 17, wherein the inner shell has a discharge aperture connecting the annular inner chamber to a radial discharge duct arranged in the outer shell, said radial discharge duct being in fluid communication with the pump outlet.

19. The centrifugal pump of claim 2, wherein said intermediate crossover module comprises an inner shell and an outer shell, said inner shell and said outer shell being arranged one inside the other.

20. A centrifugal pump, comprising:

a pump inlet;

a pump outlet;

a pump shaft;

first stages, comprising first outer diaphragms and first impellers mounted for rotation on said pump shaft;

second stages, comprising second outer diaphragms and second impellers mounted for rotation on the pump shaft; said first stages and said second stages being arranged back-to-back, the pump outlet being arranged between the first stages and the second stages; and an intermediate crossover module positioned between the first stages and the second stages, wherein the intermediate crossover module forms at least one axial transfer channel between the first stages and the second stages, and a fluid connection between the second stages and the pump outlet, and wherein the second outer diaphragms comprise through apertures forming at least one passageway, which fluidly connects said at least one axial transfer channel with an inlet of said second stages.

* * * * *